US005908208A

United States Patent [19]

Lapsker

[11] Patent Number: 5,908,208

[45] **Date of Patent: *Jun. 1, 1999**

[54] COMBINATION SAMPLE DISPENSER AND ORDER FORM DEVICE

[75] Inventor: Joshua Lapsker, Thornhill, Canada

[73] Assignee: Promex Medical Inc., Hasbrouck Heights, N.J.

[ * ] Notice: This patent is subject to a terminal disclaimer.

[21] Appl. No.: 08/687,828

[22] Filed: Jul. 26, 1996

Related U.S. Application Data

[63] Continuation of application No. 08/234,056, Apr. 28, 1994, abandoned.

[51] Int. Cl.[6] ..... B42D 15/00; B65D 83/04

[52] U.S. Cl. ..... 283/56; 283/900; 206/232; 206/461

[58] Field of Search ..... 283/56, 117, 900; 206/232, 461, 462, 467, 470

[56] References Cited

U.S. PATENT DOCUMENTS

| | | | |
|---|---|---|---|
| 1,492,101 | 4/1924 | Mordecai | 206/232 |
| 2,652,149 | 9/1953 | O'Meara | 206/232 |
| 2,877,893 | 3/1959 | Volckening et al. | 206/232 |
| 3,278,015 | 10/1966 | Bernstein | 206/461 X |
| 3,347,358 | 10/1967 | Meyers | 206/232 |
| 3,358,824 | 12/1967 | Stagnitto | 206/461 X |
| 3,621,992 | 11/1971 | Osborne et al. | 206/232 |
| 4,189,053 | 2/1980 | Stagnitto et al. | 283/62 |
| 4,240,552 | 12/1980 | Brown | 206/461 X |
| 4,266,666 | 5/1981 | Kuchenbecker | 206/461 |
| 4,553,670 | 11/1985 | Collens | 283/900 X |
| 4,569,442 | 2/1986 | Bushey | 206/470 X |
| 4,706,996 | 11/1987 | Fasham | 283/900 X |
| 4,938,462 | 7/1990 | Gould | 206/470 |
| 5,048,870 | 9/1991 | Mangini et al. | 283/81 |

FOREIGN PATENT DOCUMENTS 2515016 11/1975 Germany .

*Primary Examiner*—Frances Han
*Attorney, Agent, or Firm*—Klauber & Jackson

[57] ABSTRACT

The invention relates a combined sample dispenser and order form comprising a backing sheet that may be prepared from cardboard, and a generally planar retaining member, such as a clear plastic sheet, attached to the backing sheet along at least a portion thereof. The retaining member or plastic sheet defines a distention or pocket along a portion of its broad surface, that may contain samples of the product being dispensed, such as sample medications provided to physicians by pharmaceutical manufacturers. The invention is also useful for the sale of certain consumable items, including hardware, where the order form may be used by the consumer to directly request additional quantities of the product.

15 Claims, 3 Drawing Sheets

COMBINATION SAMPLE DISPENSER AND ORDER FORM DEVICE

This application is a continuation of application Ser. No. 08/234,056, filed Apr. 28, 1994 now abandoned.

FIELD OF INVENTION

The present invention relates generally to sample containers/dispenser and particularly to a combination sample dispenser and prescription an order form assembly for simultaneously providing a sample of an article, such as a pill, and a prescription or order form for additional quantities of the item.

BACKGROUND OF THE INVENTION

It has been the practice of pharmaceutical manufacturers to provide physicians with sample medications to be dispensed to patients. In addition, the physician may be provided with multi-sheet pads of paper or multi-sheet prescription pads preprinted with the name of a medication to be prescribed. These practices allow a physician to dispense a sample of a medication before a patient can obtain a full prescription of the medication, and to write a specific prescription conveniently.

DESCRIPTION OF PRIOR ART

A number of pharmaceutical dispensing systems have appeared in the prior art. These systems, however, fail to provide an economical as well as convenient means of dispensing prescription medication with an attached preprinted prescription sheet. For example, U.S. Pat. No. 2,652,149 to O'Meara, issued Sep. 15, 1953, which provides both a writing surface and packaging for tablets or capsules, relates to a combination package memo-pad. Holes in the pad of paper provide pockets for the tablets or capsules, which can be sealed in a flanged envelope. The envelope containing the medicinal tablets or capsules can be inserted between the sheets of paper so as to be displayed through the holes. A physician can remove one or more tablets found in the sealed flanged envelope to give a patient, and may then may write directions for the patient on the uppermost sheet of paper and remove it from the pad. The remaining sheets of paper and unused medicine are retained by the physician for later use.

U.S. Pat. No. 2,877,893 to Volekening et al., issued Mar. 17, 1959, relates to a package with a removable information sheet, e.g., a sheet of printed matter pertaining to the contents of the package. The package consists of a commodity-containing section and a pocket section. The pocket section can contain, for example, an information sheet, label, direction sheet, or a booklet pertaining to the contents of the commodity-containing section. A physician would give the commodity section to a patient and retain the information for his own use.

U.S. Pat. No. 3,347,358 to Meyers, issued Oct. 17, 1967, and U.S. Pat. No. 3,621,992 to Osborne et al., issued Nov. 23, 1971, relate to drug distribution devices for use by nurses in a hospital or by a pharmacist in which information regarding distribution of medication or preloaded syringes is controlled by recordation. U.S. Pat. No. 3,189,053 to Stagnitto et al., issued Feb. 19, 1980, relates to medicinal dispenser kit in which a pharmacist places a prescribed amount of a given medicine, into a sealable envelope. U.S. Pat. No. 5,048,820 to Mangini et al., issued Sep. 17, 1991, relates to a tray of containers of drugs with a package insert.

Each container has a multipart flag label which consists of self-adhesive stickers to be used for labeling, inventory, billing, etc.

From the above, it can be seen that the prior art does not provide a convenient and economical means for dispensing sample medication attached to a preprinted prescription sheet so as to benefit physician and patient alike. Accordingly, it is toward the fulfillment of this need by the provision of such a combined product that the present invention is directed.

SUMMARY OF THE INVENTION

In accordance with the invention, a combination sample dispensing and ordering device is prepared. The sample dispensing and ordering device includes a backing member, a planar retaining member and an ordering assembly. The planar retaining member, which is attached to the backing member, defines a distention along a portion of its broad surface to contain a sample or samples of an article. The ordering assembly is disposed between the backing member and the retaining member.

More particularly, the device of the invention may be prepared as a prescription medication sample dispenser and prescription or order form assembly. The prescription assembly includes a preprinted prescription form for the medication, and may include additional printed information about the medication.

In its use as a prescription sampler and pad, the device of the invention provides a physician with a convenient system for dispensing a sample of prescription medication to a patient, as well as a prescription for the same medication. In this aspect, the device of the invention comprises a backing member, for example cardboard, onto which a retaining member, for example a clear plastic sheet defining a distention such as a blister bubble, is secured. The distention or blister bubble which may contain samples of medication, may be backed with a pierceable material, such as foil or paper, so as to protect and facilitate removal of the sample medication.

If a pierceable material is not used, the backing for the blister bubble is the backing member. The preprinted prescription form, which may be accompanied by a second sheet containing information, may be removably attached to the backing member. The preprinted prescription form, which may be personalized for an individual physician, is used to write a prescription for an additional quantity of the sample medication.

Among the advantages of the present invention, each sample of medication can be provided with a preprinted prescription form for that particular sample medication. The physician who utilizes the present invention does not have to search a cabinet filled with sample medications and then search again for a specific prescription pad. The physician needs only to fill out the preprinted prescription form provided with the sample to allow a patient to obtain an additional quantity of the attached sample medication. Another advantage to the present invention is that it allows the patient to commence treatment immediately, rather than delaying treatment until the prescription can be filled.

Analogously, the invention provides for attachment of an order form, such as a postage-paid order form, or similar form. An individual to whom a sample of a non-prescription article, e.g., medication or device, is given can use the order form to obtain an additional quantity of the article. Thus, the present invention advantageously simultaneously provides a sample of an article with means for obtaining an additional quantity of the article.

Accordingly, it is an object of the invention to provide a device which simultaneously supplies a sample of an article and means for obtaining more of the article.

More particularly, it is an object of the invention to provide a sample of a prescription medication and a preprinted prescription form for prescribing such a medication.

It is a further object of the invention to provide a device that simultaneously provides a sample of a non-prescription conveniently packaged with an order form for obtaining more of the article.

Other objects and advantages will become apparent to those skilled in the art from the consideration of the ensuing description which proceeds with reference to the following illustration drawings.

DETAILED DESCRIPTION OF THE INVENTION

Figure 1:
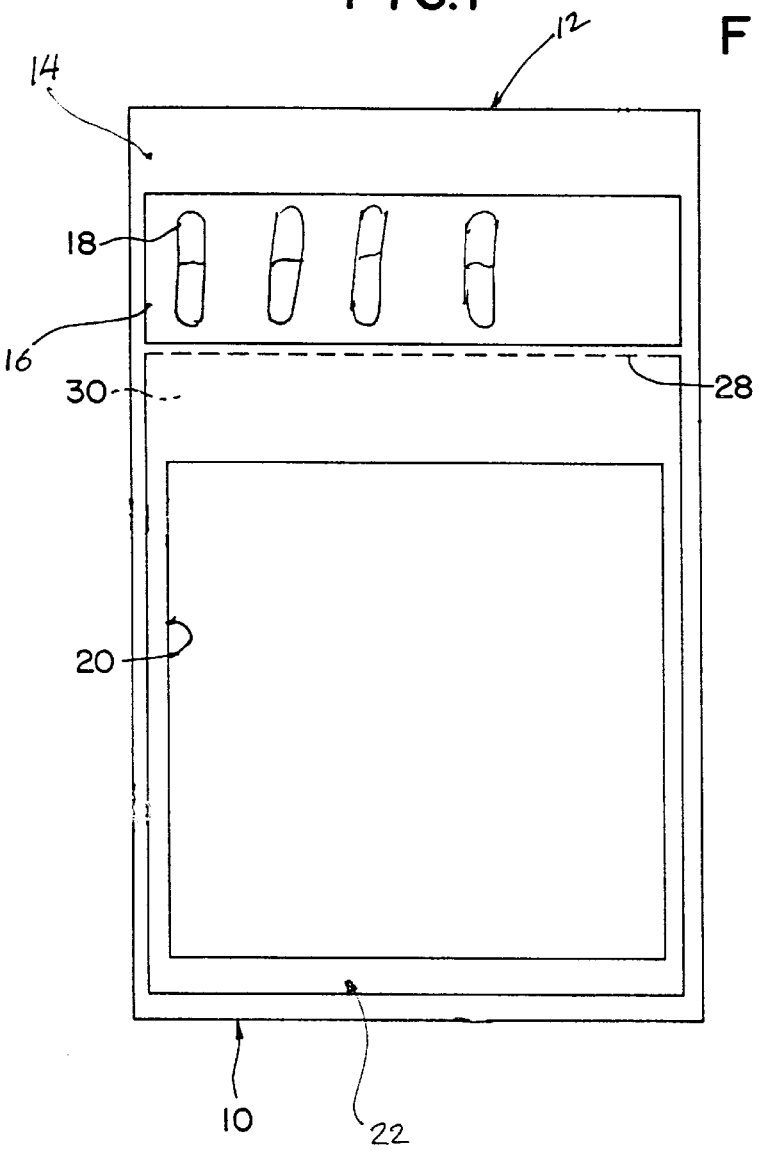
FIG. 1 is a plan view of a combination sample dispensing and ordering device in accordance with an embodiment of the invention.
Figure 2:
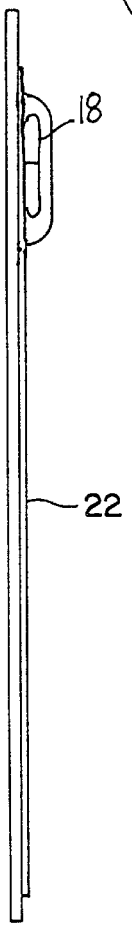
FIG. 2 is a side view of the device of FIG. 1.
Figure 3:
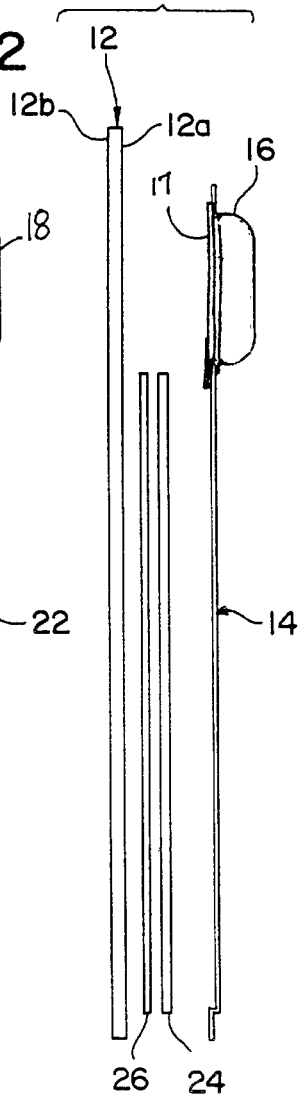
FIG. 3 is an exploded view of the device of FIG. 2.

Referring now to FIGS. 1–3, a combined sample dispenser and order device 10 is illustrated. Device 10 comprises a backing member 12 and a planar retaining member 14 attached thereto. In turn, retaining member 14 defines a distention 16 to hold product samples. Backing member 12 can be any firm material which resists bending or flexing, such as stiff plastic or cardboard, or a composite, or other suitable material. In a specific embodiment, backing member 12 is made of cardboard. Backing member 12 has a front face 12*a* as well as a back face 12*b*.

The planar retaining member 14 can be made of any material in which a distention or cavity 16 can be formed. In a specific aspect, the retaining member is a moldable plastic material. In a preferred embodiment, the material is clear or transparent to permit the sample prescription medication to be viewed. Retaining member 14 is secured to the front face of backing member 12 along at least one edge. Any means can be used to secure the retaining member to the backing member, for example, by stapling, clipping, sonic welds, or adhesive. In a preferred embodiment, the planar retaining member is attached to the backing member along its four side edges. In another embodiment, the planar retaining member is attached to the backing member along the top edge in order to permit lifting and to provide access to an ordering assembly 22.

Figure 4:
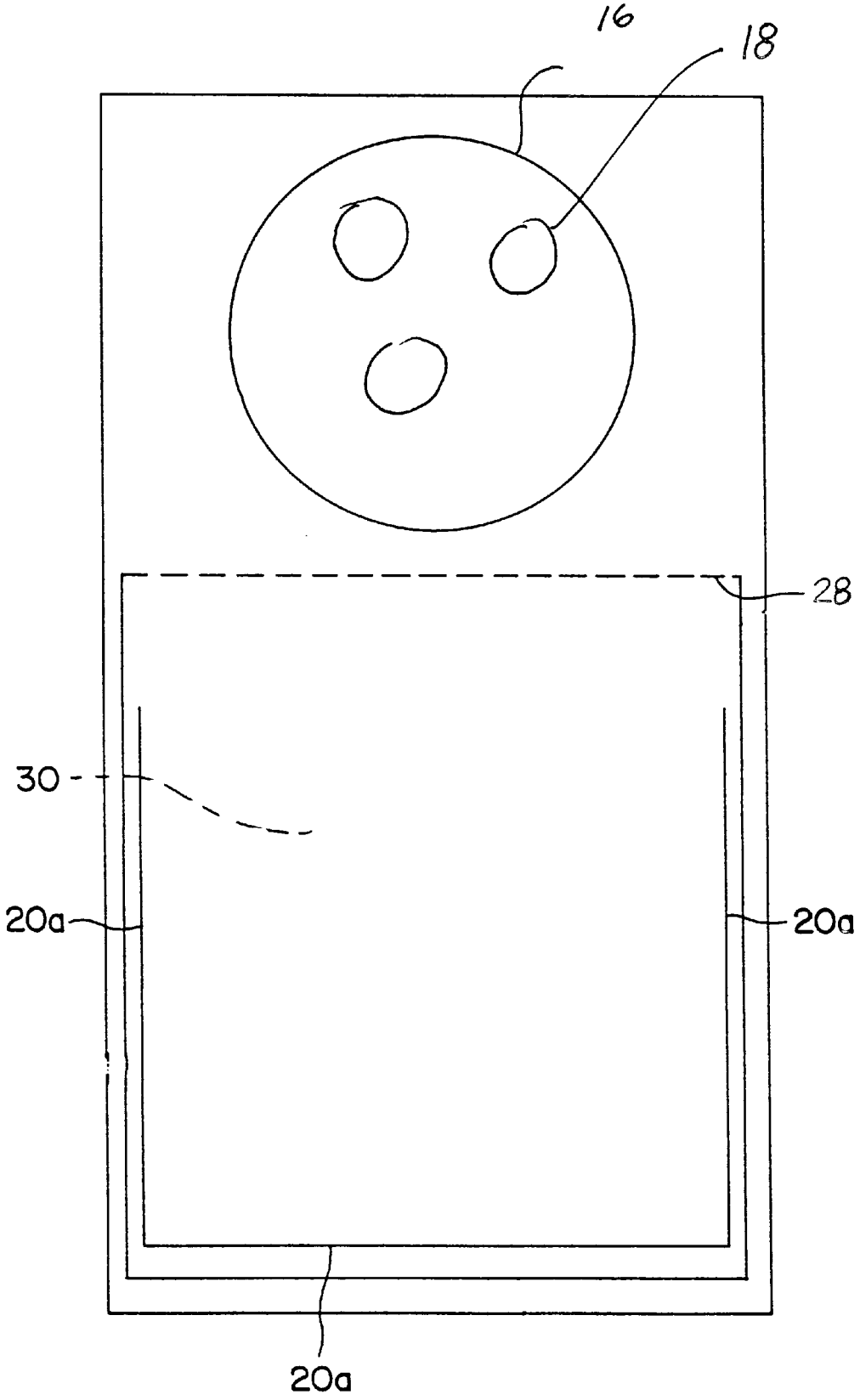
FIG. 4 is a plan view of a combination sample dispensing and ordering device in accordance with an alternate embodiment of the invention.
Figure 5:
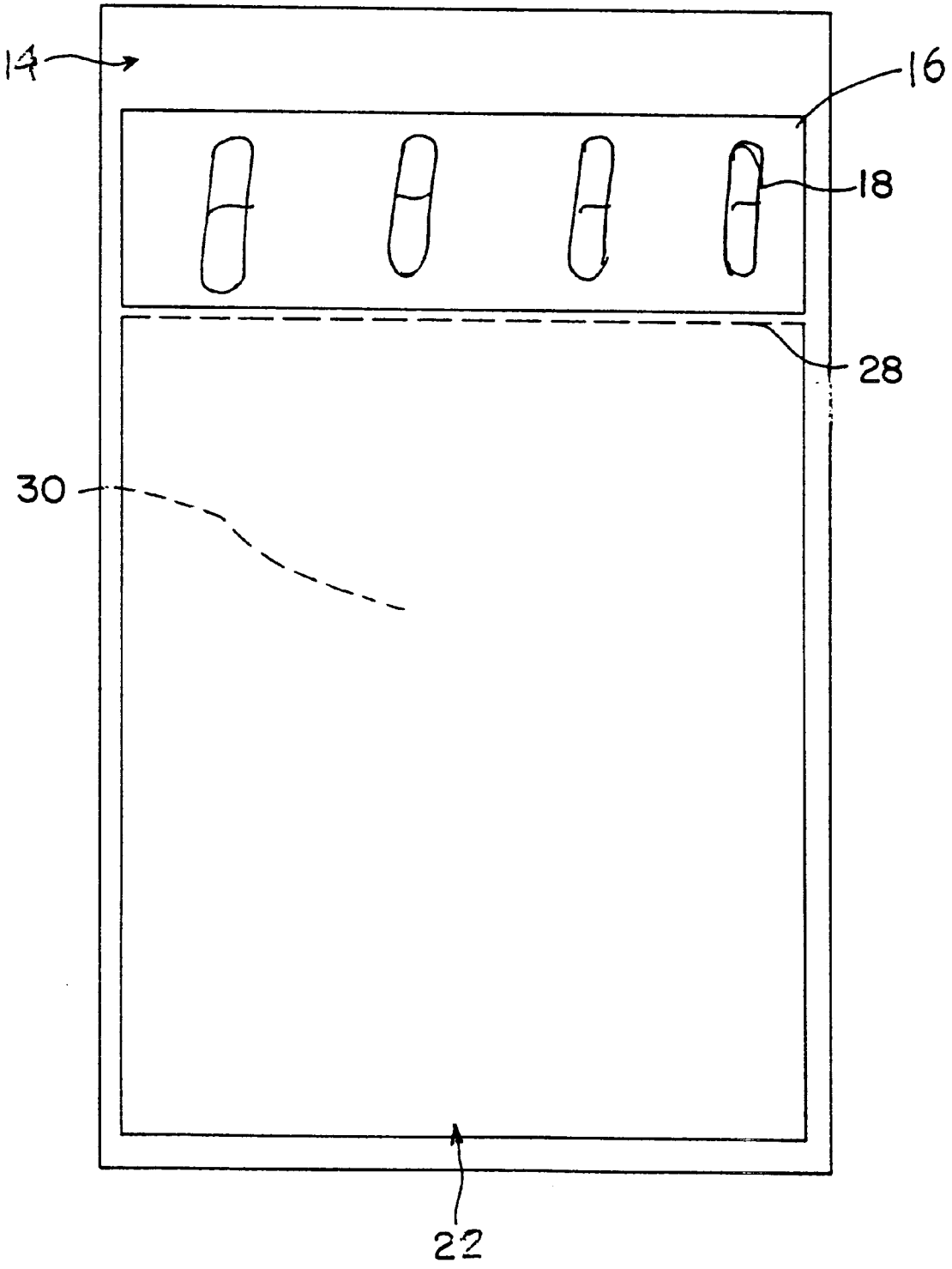
FIG. 5 is a plan view of a combination sample dispensing and ordering device in accordance with a further alternate embodiment of the invention.

As noted above, retaining member 14 has at least one article containing distention 16, such as a blister bubble. Distention 16 may be modified to accommodate different sizes and quantities of a sample product or article. For example, distention 16 may define a rectangular perimeter as shown in FIGS. 1 and 5, or may have a circular perimeter as shown in FIG. 4. The remaining portion of the planar retaining member extends over the ordering assembly 22 card.

A seal of pierceable material 17, shown in FIGS. 2 and 3, such as foil or paper may cover the back of the distension to enhance shelf life or facilitate removal of the product sample or article. In an alternate embodiment not shown, the backing member may define a portal covered by such prescribed material. The distention would then be superimposed over such a portal. Alternatively, the retaining member may be attached on one side, defining a hinge, whereby lifting the retaining member provides access to the product sample or article by piercing the pierceable material.

In a preferred embodiment, there is an excised portion defined by a border 20 of the same dimensions and at the same locations as the ordering assembly. This excised portion exposes and permits access to the ordering assembly for inscription and removal.

In another embodiment shown in FIG. 5, the extending portion of the planar retaining member 14 defines a hinge comprising as illustrated, a score line 28, to permit retaining member 14 to be lifted to provide access to the ordering assembly.

Alternatively, the extending portion may be cut along three sides 20*a* corresponding to the dimensions and the locations of the ordering assembly to form a flap which is lifted to access the ordering assembly, as shown in FIG. 4.

The ordering assembly 22 is comprised of a single order form 24, and may include one or more sheets containing additional information 26 concerning the product sample or article.

The ordering assembly can be secured to the backing member along one or more edges in any suitable manner, for example, staple, clip or adhesive, so as to permit lifting and removal of the ordering assembly. Additionally, the ordering assembly may be perforated, scored or weakened in some manner, as by score line 28, in order to facilitate the removal of sheets from the ordering assembly.

In another embodiment, the ordering assembly may be a portion of the backing member, which may itself contain a preprinted order or prescription form. Accordingly, the backing member can be detachable from the device, so that the completed order form can be used to obtain an additional quantity of the article. In a further embodiment, the retaining member can also be detachable.

As used herein, the term "ordering assembly" refers to an assembly that comprises an ordering form useful for obtaining an additional quantity of the sample article. In a preferred embodiment, the term "ordering form" refers to a prescription form. The ordering form preferably contains preprinted information, space for which is provided on the ordering form. In a preferred embodiment, a prescription form is preprinted with the name and dosage of the sample medication, the doctor's name, address, and Drug Enforcement Number, a space for the patient's name and address as well as spaces and boxes for the doctor to complete regarding the amount of the prescription and whether there are to be refills. The prescription form is prepared in preprinted form to follow all of the formats of the respective states in which the form may be distributed and used.

Alternatively, the ordering form can contain a preprinted postal or mailing address, and space for inscribing ordering information such as name and address, the amount being ordered, and perhaps a method of payment. The ordering form may be a post card with prepaid postage, or a form to be sent in a separate envelope.

The product sample or articles may be removed from the distension by removing the backing member. If a seal of pierceable material covers the back of the distension it must be peeled from the back of the planar retaining member or pierced, for example by cutting or piercing with a sharp object, to remove the article.

As noted above, a sample of any article can be provided in the device of the present invention. Preferably, the article is on the order of about 0–5 cm to about 10 cm in any dimension. Examples of such articles are pills, capsules and tablets of prescription or non-prescription medications. Small tubes of creams, lotions, and the like or small packages of cosmetics can also be provided. In a further aspect, the distention may contain devices such as a condom, cosmetic brush, razor blade, and the like.

In a further aspect, the article may be a food or a food additive, such as a flavoring or color agent, as well as non-food articles, such as, for example, hardware fittings that may desirably accompany O.E.M. equipment, to facilitate the reordering of fungible, consumable parts.

The present invention is not to be limited in scope by the specific examples disclosed herein. Indeed, various modifications of the invention in addition to those described herein will be apparent to one of skill in the art from the foregoing description and accompanying figures. Such modifications are intended to fall within the scope of the appended claims.

What is claimed is:

1. A combination sample dispensing and ordering device comprising:

a backing member having a front face and a back face;

a retaining member attached to the front face of the backing member, which retaining member defines a broad surface along a portion thereof, and a distention to contain an article; and a preprinted ordering assembly contained within said combination device, comprising an order form disposed between the backing member and the retaining member, said ordering assembly being removably attached to said backing member and perforated, scored or otherwise weakened in its manner of attachment to said backing member to permit removal therefrom, and said order form is an official prescription form compliant with governmental regulations for prescribing controlled pharmaceutical products;

the portion of the broad surface of said retaining member proximate to said distention is attached to said front face to prevent the involuntary release of said article from said distention, and the portion of the broad surface of said retaining member proximate to said ordering assembly is movable as by lifting to access said ordering assembly;

wherein said ordering assembly may be removed from between said backing member and said retaining member without exposing said article to release.

2. The device according to claim 1 in which the backing member is cardboard.

3. The device according to claim 1 in which the planar retaining member is a clear plastic sheet.

4. The device sample card according to claim 1 in which the planar retaining member defines an opening to access the ordering assembly.

5. The device according to claim 4 in which the opening is an excised portion.

6. The device according to claim 4 in which the retaining member is cut along the perimeter of the broad surface so as to permit lifting of the cut portion of said broad surface to access said opening.

7. The device according to claim 1 in which the distention is a blister bubble.

8. The device according to claim 1 in which the distention is backed with a pierceable material.

9. The device according to claim 1 in which the article comprises one or more sample medications.

10. The device according to claim 1 in which the ordering assembly is a form removably attached to the backing member.

11. The device according to claim 1 in which the ordering assembly further comprises an information sheet.

12. The device according to claim 11 in which the information sheet is attached to the backing member.

13. The device according to claims 1 in which the prescription sheet is personalized.

14. The device according to claim 1 in which the order form contains a mailing address.

15. The device according to claim 1 in which the planar retaining member is hinged across its broad surface to permit lifting so to access the ordering assembly.

* * * * *